United States Patent [19]

Wing

[11] Patent Number: 4,502,566

[45] Date of Patent: Mar. 5, 1985

[54] WALL STAND-OFF APPARATUS

[75] Inventor: Harold R. Wing, Springville, Utah

[73] Assignee: Little Giant Industries, Inc., Provo, Utah

[21] Appl. No.: 479,220

[22] Filed: Mar. 28, 1983

[51] Int. Cl.[3] ..... E06C 7/48

[52] U.S. Cl. ..... 182/214; 182/107

[58] Field of Search ..... 182/214, 107, 108, 206; 248/210, 211, 238, 228, 226.2, 226.4; 24/457, 492, 514, 569

[56] References Cited

U.S. PATENT DOCUMENTS

| | | | |
|---|---|---|---|
| 1,471,848 | 10/1923 | Johnson | 182/214 |
| 1,579,136 | 3/1926 | Paxson | 248/228 |
| 2,327,317 | 8/1943 | Randall | 182/214 |
| 2,903,086 | 9/1959 | Chubbs | 182/214 |
| 3,268,196 | 8/1966 | Anton | 182/214 |
| 3,288,249 | 11/1966 | Gibson | 182/214 |
| 4,061,203 | 12/1977 | Spencer | 182/214 |

OTHER PUBLICATIONS

Little Giant Industries, "The Little Giant Wall Stand-Off Stands Up To Tricky Ladder Tasks", (advertising brochure).

*Primary Examiner*—Reinaldo P. Machado

*Attorney, Agent, or Firm*—Workman, Nydegger & Jensen

[57] ABSTRACT

A wall stand-off apparatus and method for supporting virtually any ladder adjacent to a substantially vertical surface. The novel wall stand-off apparatus of the present invention comprises a U-shaped support bar which forms two, substantially parallel legs. Each leg is provided with an extension member, such that the legs are individually adjustable in length.

Two clamps are pivotally connected to the support bar. Each clamp comprises two movable, opposing jaws which are adapted to be attached to a portion of the ladder which is inserted therebetween. Each clamp includes a thumbscrew such that when a ladder's side rail or rung is inserted into the clamp, the thumbscrew may be tightened so as to firmly secure the clamp to the ladder. With both clamps properly secured to either the side rails or a rung of a ladder, the ladder may thereafter be leaned against a substantially vertical wall, with the legs of the support bar resting against the wall. The length of each leg may then be adjusted, as needed, by using the above-mentioned leg extension members.

29 Claims, 7 Drawing Figures

WALL STAND-OFF APPARATUS

BACKGROUND

1. The Field of the Invention

This invention relates to ladder accessories and, more particularly, to a wall stand-off apparatus for supporting and stabilizing a ladder adjacent a substantially vertical surface.

2. The Prior Art

Ladders have been used by nearly everyone to perform some kind of construction or repair task. For example, ladders are frequently used when painting or wallpapering a room or when framing or finishing a new structure.

Despite the wide use of ladders, however, a significant number of household and construction accidents occur each year which are related to ladder use. Of course, some of these accidents result from the negligence of the individual using the ladder, and other accidents can perhaps be traced to faulty ladder design or construction. However, there are several situations in which the use of a ladder remains awkward and/or dangerous in spite of the fact that the ladder is well-designed and constructed and that the user is reasonably careful during its use.

One such situation arises when it is necessary to work at or near the top of a ladder which is leaning against a vertical support. For example, when working on the outside of a house, the edges of the roof generally hang over the outside vertical walls, thereby making it awkward to work near the top of a ladder which lies directly below the roof. Working under other types of overhangs may similarly make ladder work difficult. Unfortunately, in such a situation the user often finds himself standing very close to the top of the ladder with nothing to hang onto. He may also be required to attempt some awkward and dangerous reaching in order to accomplish his desired objective. These factors, of course, may contribute significantly to the danger of ladder use.

Another common situation in which proper ladder use may be awkward arises when a ladder must be used adjacent windows and shrubs. As a general rule, the base of a ladder should be positioned one foot away from the ladder's vertical supporting surface for every four feet of ladder length. However, when working adjacent windows and shrubs, it is frequently difficult to maintain this proper slope. Often, for example, if the ladder were to be positioned properly, the top of the ladder would rest against a window; consequently, in order to avoid damaging the window, the ladder user either positions the top of the ladder just below or above the window. Thus, the user may find that the ladder is improperly positioned to support him. Similar problems may arise when a ladder must be used adjacent shrubs, since the proper positioning of the base of the ladder may be impossible.

A further situation which may make ladder use awkward or dangerous occurs when a ladder must be used adjacent an uneven vertical surface. Occasionally, an individual will simply place a ladder against an uneven surface and then attempt to climb the ladder, even though only one of the ladder's side rails is actually in contact with the vertical supporting surface. It will be readily appreciated that this situation creates a substantial danger, and a ladder so positioned will frequently twist away from the supporting surface and fall.

The inherent danger of ladder usage is also increased when a ladder is used on very tall jobs or in connection with heavy loads. In such cases, the ladder may bow, or even collapse, in the middle; and the ladder may also twist during use, thereby causing both the ladder and its user to fall.

In order to minimize the awkwardness and danger involved in each of the above-mentioned situations, those skilled in the art have commonly used a device called a wall stand-off. As illustrated in FIG. 7, a typical prior art stand-off comprises two support arms 110 which are connected to the side rails 92 of a ladder 90 by means of bolts 112. By using this device, one may easily work adjacent the top of the ladder while still having sufficient room to hang onto the top of the ladder's side rails. Additionally, since the ladder is supported a predetermined distance from the supporting wall, awkward and dangerous reaching can be minimized. It will further be appreciated that this prior art stand-off can be positioned such that the proper ladder slope is maintained when the ladder is used adjacent windows or shrubs. Also, by making one of the support arms longer than the other, the stand-off can facilitate ladder usage against uneven vertical surfaces. Finally, the prior art stand-off could also be positioned adjacent a central portion of the ladder in order to provide additional support when the ladder is used with heavy loads.

However, in spite of the advantages of the prior art type of wall stand-off there are several disadvantages associated with its use. First, it will be appreciated that since the stand-off's arms 110 are bolted to the side rails 92 of the ladder 90, the stand-off is somewhat inconvenient to remove. Significantly, a worker often finds himself without the correct tools to remove the stand-off. Consequently, when using a ladder to which a stand-off has been attached, a worker may try to use the ladder without removing the stand-off. There are numerous situations in which the use of a stand-off would not be appropriate and would tend to increase the danger of ladder usage.

Additionally, the prior art type stand-off is somewhat burdensome to attach to a ladder. Typically, both the stand-off's support arms and the ladder's side rails must be drilled or otherwise provided with appropriate holes to receive the bolts. Thus, if it later becomes desirable to use the stand-off at a different position along the length of the ladder's side rails, the side rails would have to be re-drilled at the appropriate location. In addition to being inconvenient, frequent drilling may, of course, weaken the ladder and precipitate ladder failure. Additionally, since the prior art stand-offs are typically not mass produced, a stand-off may rarely be used on more than one ladder. Further, the prior art stand-off's support arms are not readily adjustable in length; thus, it is difficult to use the prior art stand-off against an uneven vertical surface.

OBJECTS AND BRIEF SUMMARY OF THE INVENTION

In view of the shortcomings and problems of the present state of the art, it is a primary object of the present invention to provide a sturdy, universal wall stand-off which may be easily used on virtually any ladder and in any situation.

It is another object of the present invention to provide a universal wall stand-off which securely attaches to a ladder without the need for drilling holes in the ladder and without the need for special tools.

It is still another object of the present invention to provide a wall stand-off which may be rapidly connected and disconnected to a ladder and which may be positioned at any point along the ladder's length.

Further, it is an object of the present invention to provide a wall stand-off which may be easily attached to either the side rails or to a rung of a ladder.

It is a still further object of the present invention to provide a wall stand-off with adjustable support arms, whereby the ladder may be firmly supported at various distances away from a substantially vertical wall and may also be properly supported adjacent uneven vertical surfaces.

It is also an object of the present invention to provide a wall stand-off which is easy to manufacture and assemble.

In accordance with the foregoing objects, the present invention is directed to a wall stand-off which is simple, yet structurally stable, and which may be used on virtually any ladder. The novel wall stand-off apparatus of the present invention comprises a U-shaped support bar which forms two, substantially parallel legs. Importantly, each leg is provided with an extension member, such that the legs are individually adjustable in length.

Two clamps are rotatably connected to the U-shaped support bar. Each clamp comprises two movable, opposing jaws which are adapted to hook around a portion of a ladder which is inserted therebetween. Each clamp further includes a thumbscrew such that, when a ladder's side rail or rung is inserted into the clamp, the thumbscrew may be tightened so as to firmly secure the clamp to the ladder.

With both clamps properly secured to either the side rails or a rung of a ladder, the ladder may thereafter be leaned against a substantially vertical wall, with the legs of the support bar resting against the wall. The length of each leg may then be adjusted, as needed, by using the above-mentioned leg extension members.

The above-mentioned and other objects and features of the present invention will become more fully apparent from the following description and appended claims taken in conjunction with the accompanying drawings.

DETAILED DESCRIPTION OF THE PRESENTLY PREFERRED EMBODIMENT

Reference is now made to the figures wherein like parts are designated with like numerals throughout. It will be readily appreciated that the components of the present invention, as generally described and illustrated in the figures herein, could be arranged and designed in a wide variety of different configurations. Thus, the following more detailed description of the embodiment of the apparatus and method of the present invention, as represented in FIGS. 1–6, is merely representative of one presently preferred embodiment of the invention.

Figure 1:
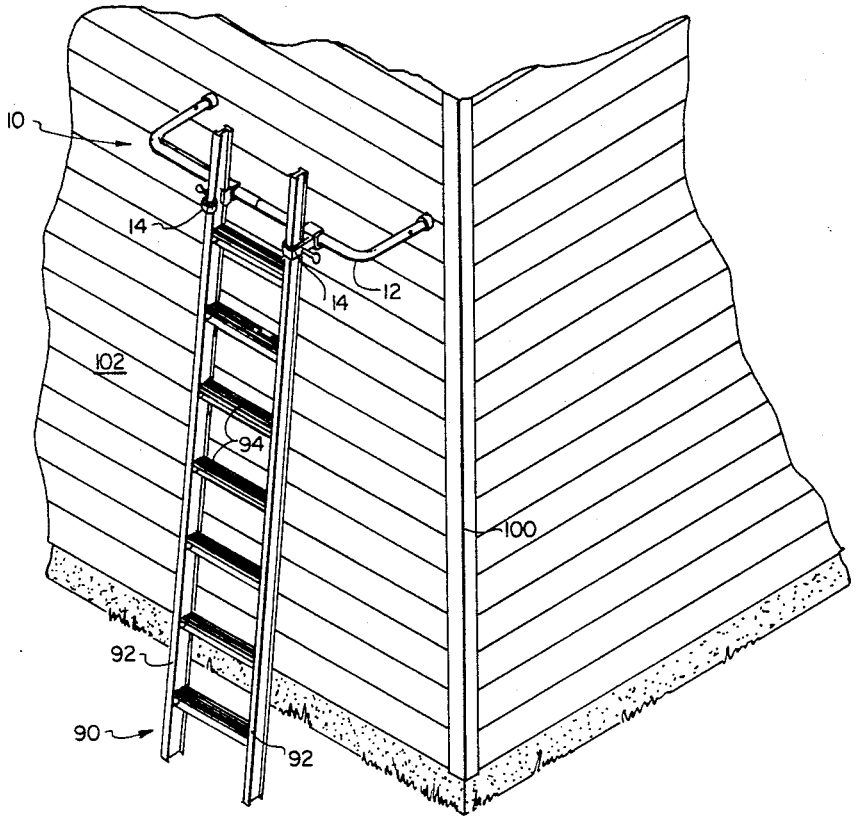
FIG. 1 is a perspective view of one presently preferred embodiment of the wall stand-off apparatus of the present invention connected to the side rails of a ladder.

The wall stand-off of the present invention, generally designated 10, is seen in its entirety in FIG. 1. Wall stand-off 10 comprises a U-shaped support bar 12 which has two clamps 14 connected thereto. As shown in FIG. 1, clamps 14 may be secured adjacent the tops of side nails 92 of a ladder 90. With clamps 14 so secured, wall stand-off 10 firmly supports the top of ladder 90 at a predetermined distance away from a vertical wall 102 of a building 100.

Figure 2:
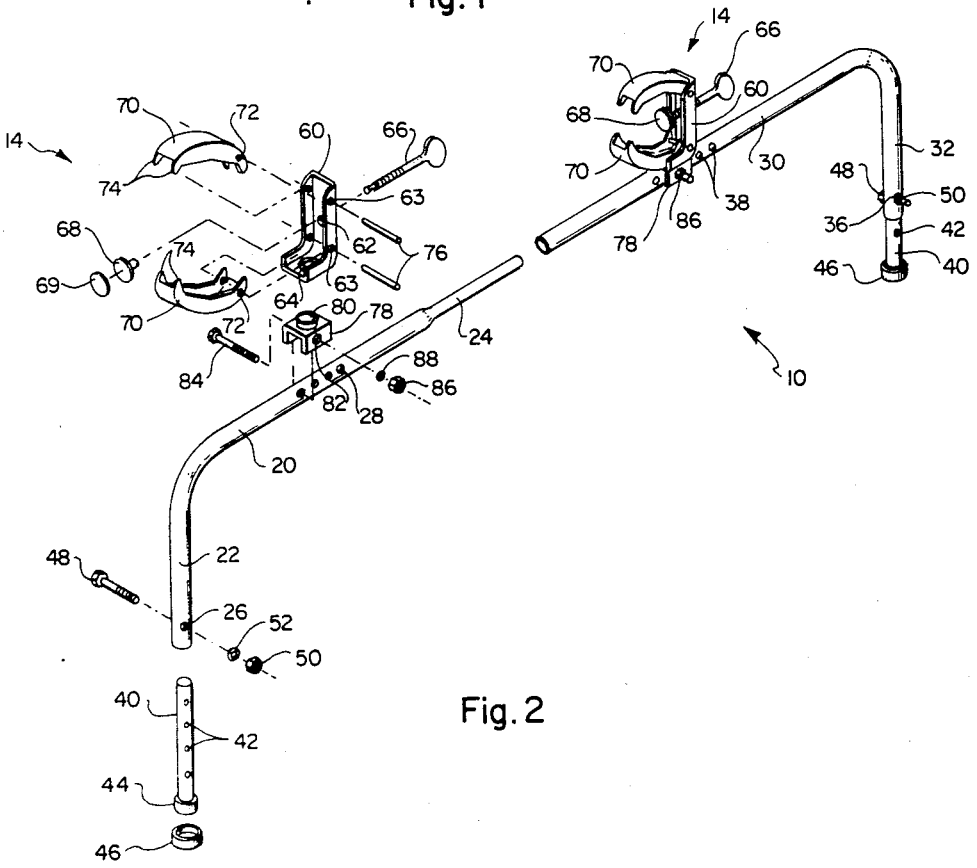
FIG. 2 is a partially exploded perspective view of one presently preferred embodiment of the wall stand-off apparatus of the present invention.

With particular reference now to FIG. 2, support bar 12 may be formed as a generally hollow, tubular structure. Also, in order to facilitate transportation and storage, and for additional reasons which will become more fully apparent from the discussion which follows, support bar 12 is preferably formed in two sections 20 and 30. Sections 20 and 30 are bent so as to form support legs 22 and 32, respectively. In addition, an end portion 24 of section 20 which is opposite support leg 22 has a reduced diameter, such that end portion 24 of section 20 may be telescopically inserted into the open end of section 30 which is opposite support leg 32. Thus, when sections 20 and 30 of support bar 12 are properly connected together, the two support bar sections form a generally U-shaped structure, with legs 22 and 32 being substantially parallel.

In order to make wall stand-off 10 more versatile, it is preferable to make support legs 22 and 32 adjustable in length. Accordingly, legs 22 and 32 may each be provided with an extension member 40. As depicted in FIG. 2, extension members 40 are also generally tubular structures, and they have a diameter which permits them to reside telescopically within the open ends of legs 22 and 32. Advantageously, support legs 22 and 32 may have holes 26 and 36, respectively, therein; and extension members 40 may have corresponding holes 42 therein such that, when extension members 40 are properly inserted into legs 22 and 32, a bolt 48 may be used to secure the extension members within the legs at the appropriate position. Bolts 48 may thereafter be secured in place by means of nuts 50 and lock washers 52.

Additionally, in order to prevent undue wear on the wall or other surface upon which wall stand-off 10 may be used, extension members 40 may be provided with a suitable cap 46. The end 44 of extension member 40 upon which cap 46 is placed may also be flared, as shown, in order to help secure cap 46 upon extension member 40.

Figure 3:
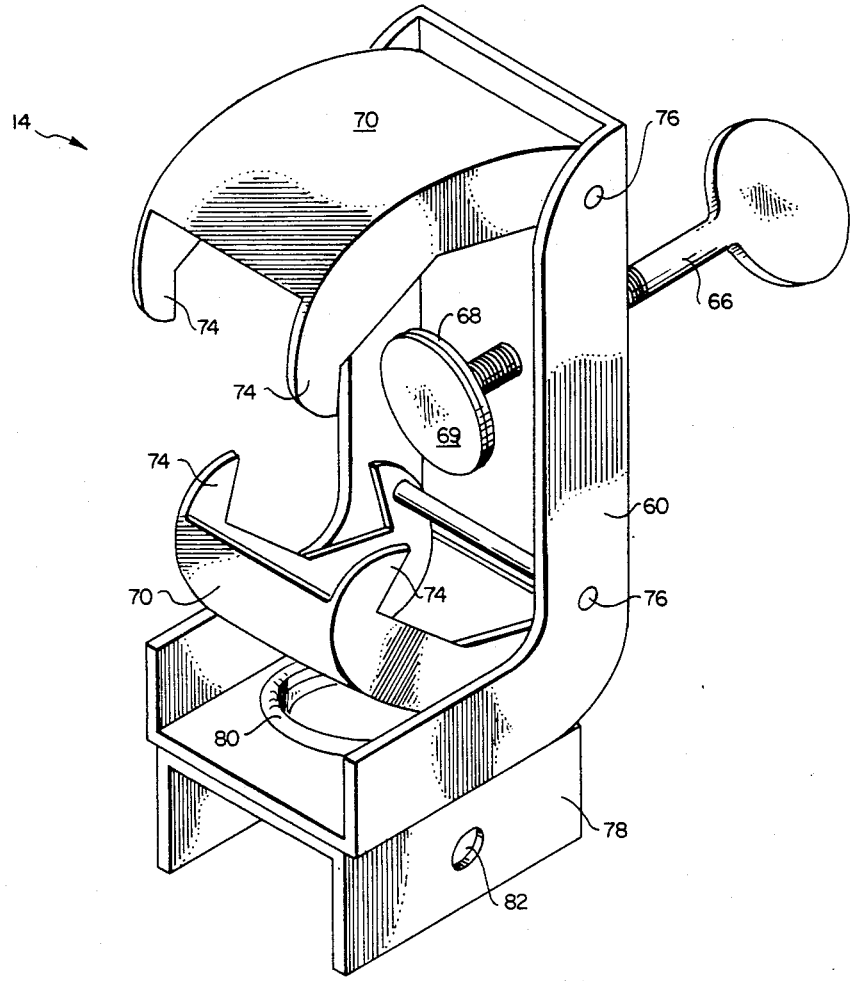
FIG. 3 is an enlarged perspective view of one presently preferred embodiment of a clamp of the wall stand-off apparatus of the present invention.

Clamps 14 of wall stand-off 10 comprise a clamp body 60, two jaws 70, and a clamp base 78. As depicted in FIGS. 2 and 3, clamp body 60 is a U-channel structure which is formed in an L-shaped configuration. A threaded hole 62 is formed through the back of clamp body 60 and is adapted to receive the threaded portion of thumb screw 66. Thumb screw 66 has a disc-like stop member 68 rotatably connected to the end thereof; and, in order to minimize abrasion on the ladder structure, stop 68 may also be provided with a thin pad 69.

Jaws 70 of clamp 14 are also U-channel structures, and they are formed in a somewhat curved fashion, as shown, so as to be capable of gripping an object such as the side rails or rung of a ladder. Thus, the leading ends 74 of jaws 70 have a hook-like configuration. The opposite end of jaws 70 have holes 72 therein. Corresponding holes 63 are formed in clamp body 60 such that jaws 70 may be pivotably mounted to clamp body 60 by means of long rivet members 76.

Clamp base 78 is formed as an inverted U-channel structure having a short, upstanding tube 80 formed on the top thereof. A corresponding hole 64 is formed in the bottom of clamp body 60 such that clamp body 60 may be placed on top of tube 80. As illustrated more particularly in FIG. 3, once clamp body 60 is so positioned on top of clamp base 78, upstanding tube 80 may be flared so as to rotatably secure clamp body 60 to clamp base 78. Of course, clamp body 60 could be welded or otherwise rigidly secured to clamp base 78. However, the versatility of wall stand-off 10 is increased if clamp body 60 is rotatably mounted to clamp base 78 as described above.

With support bar 12 and clamp 14 constructed as described above, clamps 14 are then connected to support bar 12. Clamps 14 may be connected to support bar 12 in any suitable manner. For example, clamps 14 may be secured to support bar 12 by means of bolts 84 which are inserted through holes 82 in clamp base 78 and through corresponding holes 28 and 38 in support bar 12. In the illustrated embodiment, a plurality of holes 28 are provided in each section 20 and 30 of support bar 12 so that the position at which each clamp 14 is connected to the support bar can be varied. Thus, by adjusting the clamps 14 in this manner, and/or by adjusting the width of the telescopically engaged sections 20 and 30, the apparatus can be adjusted to fit virtually any ladder.

Figure 4:
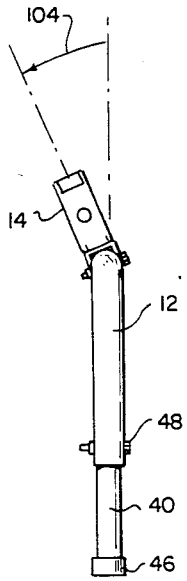
FIG. 4 is an end elevational view.

Importantly, as illustrated in FIG. 4, clamps 14 should be connected to support bar 12 so as to form a slight angle (illustrated by arrow 104), with the plane which is defined by support bar 12. This angle should be such that wall stand-off 10 lies substantially in a horizontal plane when it is attached to a ladder having the proper incline. As mentioned previously, a ladder should generally be sloped such that the base of the ladder is one foot away from the ladder's vertical supporting surface for every four feet of ladder length. Accordingly, the angle illustrated by arrow 104 should be between approximately ten degrees and fifteen degrees.

Wall stand-off 10 may be constructed as described above from a number of suitable materials. In fact, virtually any durable, rigid material could be used. In one preferred embodiment, for example, wall stand-off 10 is constructed almost entirely of aluminum. Likewise, the various component parts of wall stand-off 10 could be constructed in a wide variety of configurations. For example, support bar 12 could have a rectangular or triangular cross-section, rather than a substantially circular cross-section as illustrated and described above. Similarly, support bar 12 could have square corners or, alternatively, could assume a more curved configuration. Clamp 14 could likewise be formed in various other configurations, including forming clamp body 60 in a C-shaped configuration, with jaws 70 being formed in a more rectangular, linear configuration.

Figure 5:
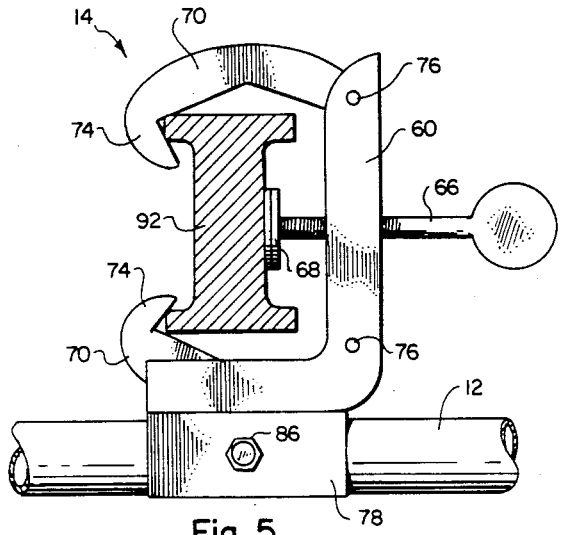
FIG. 5 is a side elevational view of a clamp of the wall stand-off apparatus of the present invention as it would be secured to a side rail of a ladder.

When wall stand-off 10 is constructed and assembled as described above, it may be easily attached to a ladder for use. Prior to installation, one must first attach the clamps 14 to support bar 12 such that a ladder may be placed between the clamps. Since most ladders are of a similar width, this adjustment will only infrequently be necessary. Clamps 14 are then turned inward as depicted in FIG. 1. Thereafter, side rails 92 of a ladder 90 are inserted within clamps 14 such that jaws 70 grip the edges of side rails 92, as illustrated in FIG. 5. Thumb screws 66 are then tightened so as to secure side rails 92 within clamps 14. It should be noted that sections 20 and 30 of support bar 12 may be separated slightly during the tightening of thumb screws 66; such separation will permit each clamp 14 to fit snugly onto a side rail 92. Finally, extension members 40 may be adjusted to the appropriate position so as to properly support ladder 90 adjacent wall 102 of building 100.

Figure 6:
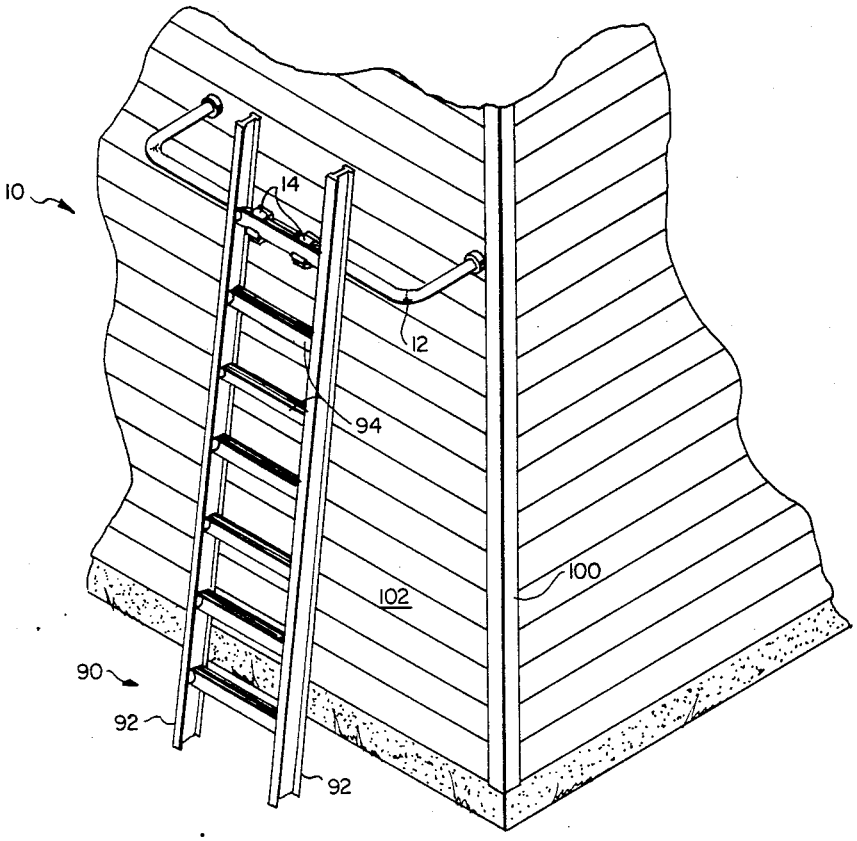
FIG. 6 is a perspective view of one presently preferred embodiment of the wall stand-off apparatus of the present invention connected to a rung of a ladder.
Figure 7:
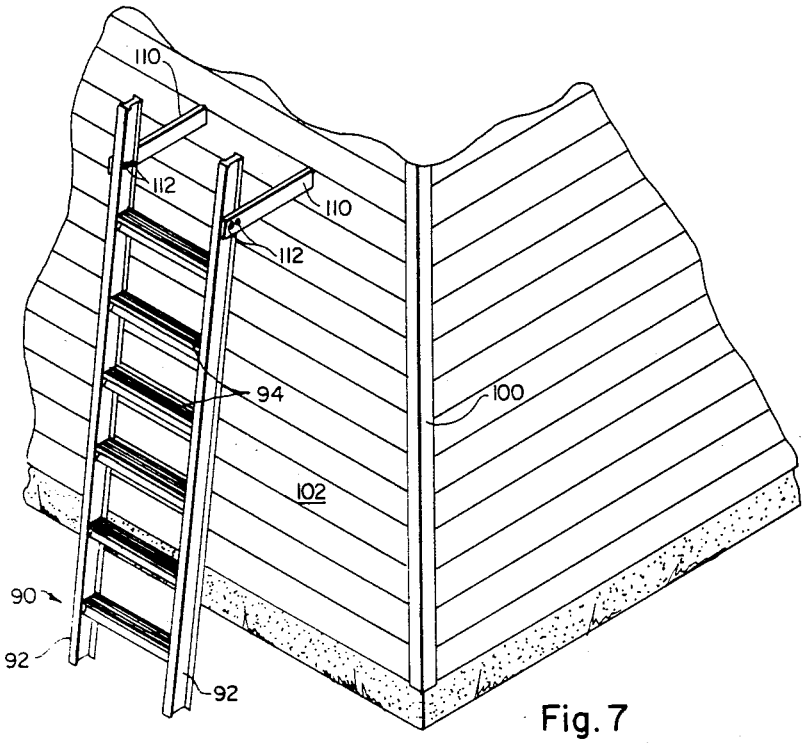
Fig. 7 (PRIOR ART)
FIG. 7 is a perspective view of a prior art type wall stand-off connected adjacent the top of a ladder.

Because clamps 14 are rotatably connected to support bar 12, clamps 14 may also be connected to a rung 94 of a ladder 90. Such an attachment is illustrated in FIG. 6. Although wall stand-off 10 is illustrated in FIG. 6 as being attached to the top rung of a ladder, it will be readily appreciated that wall stand-off 10 could be rigidly attached to any rung of a ladder. Similarly, wall stand-off 10 could be easily connected at any position along the entire length of side rails 92 of ladder 90.

From the above discussion, it will be appreciated that the present invention provides a sturdy, universal wall stand-off which may be used on virtually any ladder. Because of the unique clamps which are used in the wall stand-off of the present invention, the present invention provides a stand-off which may be firmly connected to a ladder without the need for special tools or drilling. Since the clamps of the wall stand-off of the present invention may be tightened and loosened by hand, there is no need to carry special tools when removing the stand-off, and the present invention provides a wall stand-off which may be quickly removed and positioned anywhere along the entire length of a ladder. Since the legs are provided with extension members, the present invention also provides a wall stand-off having adjustable legs such that a ladder may be supported at various distances away from a vertical wall and may also be used adjacent uneven vertical surfaces. Further, it will be appreciated that the present invention provides a wall stand-off which is easy to manufacture and assemble. Thus, the present invention provides a method for reliably supporting a ladder adjacent a substantially vertical wall, without the need for drilling (or otherwise providing) holes in the ladder structure.

The invention may be embodied in other specific forms without departing from its spirit or essential characteristics. The described embodiments are to be considered in all respects only as illustrative and not restrictive and the scope of the invention is, therefore, indicated by the appended claims rather than by the foregoing description. All changes which come within the meaning and range of equivalency of the claims are to be embraced within their scope.

What is claimed and desired to be secured by United States Letters Patent is:

1. A wall stand-off apparatus for supporting a ladder adjacent to a substantially vertical surface, said ladder having a pair of side rails for supporting a plurality of ladder rungs therebetween; and said apparatus comprising:

first means for supporting said ladder at a spaced distance from said surface; and second means, connected to said first means, for removably clamping said first means to said ladder; said second means being capable of selective clamping either to one of said ladder rungs or said side rails.

2. An apparatus as defined in claim 1 wherein said first means comprises:

means for adjusting the width thereof; and means for adjusting said distance at which said ladder is spaced from said surface.

3. An apparatus as defined in claim 1 wherein said second means is pivotally mounted to said first means.

4. An apparatus as defined in claim 1 wherein said second means comprises means for adjusting the position where said second means is connected to said first means.

5. An apparatus as defined in claim 1 wherein said first means comprises a support member formed from two sections, each said section having a leg which extends therefrom so as to engage said surface, said sections being telescopically attached to one another.

6. An apparatus as defined in claim 5 wherein each said leg comprises an extensible member which may be adjusted for purposes of adjusting the distance at which said ladder is spaced from said surface.

7. An apparatus as defined in claim 5 wherein said second means comprises a pair of clamps, each said clamp being pivotally mounted to one of said sections of said support member.

8. An apparatus as defined in claim 7 wherein each said clamp comprises:

a pair of opposing jaws; and means for securing selectively each said pair of opposing jaws to one of said ladder rungs or said side rails of said ladder.

9. An apparatus as defined in claim 7 wherein each said clamp comprises means for adjusting the position on said sections where each said clamp is mounted.

10. A wall stand-off apparatus for supporting a ladder adjacent to a substantially vertical surface, said ladder having a pair of side rails for supporting a plurality of ladder rungs therebetween, and said apparatus comprising:

first means for supporting said ladder at a spaced distance from said surface, said first means comprising (a) means for adjusting the width thereof, and (b) means for adjusting said distance at which said ladder is spaced from said surface; and second means, pivotally mounted to said first means, for removably clamping said first means to said ladder; said second means being capable of selective clamping either to one of said ladder rungs or said side rails.

11. An apparatus as defined in claim 10 wherein said second means comprises means for adjusting the position at which said second means is pivotally mounted to said first means.

12. An apparatus as defined in claim 10 wherein said first means comprises a support member having a pair of sections, each said section having a leg which extends therefrom for engaging said surface so as to support said ladder at said spaced distance from said surface.

13. An apparatus as defined in claim 12 wherein said means for adjusting the width comprises means for telescopically engaging said sections one to another in a sliding fashion so that the width of said support member can be adjusted by sliding said sections relative to one another.

14. An apparatus as defined in claim 12 wherein said means for adjusting said distance at which said ladder is spaced from said surface comprises an extension member telescopically engaged to each said leg of said section, each said extension member being separately adjustable so as to be able to separately vary the distance at which said ladder is spaced from said surface.

15. An apparatus as defined in claim 12 wherein said second means comprises a pair of clamps, each said clamp comprising:

a clamp base connected to one of said sections of said support member;

a rigid clamp body pivotally connected to said clamp base;

two opposing jaws which are pivotally connected to said clamp body, said jaws being adapted to be attached selectively to one of said ladder rungs or said side rails; and means for securing said jaws selectively to one of said ladder rungs or said side rails.

16. An apparatus as defined in claim 15 wherein each said clamp further comprises means for adjusting the position at which said clamp base is connected to said section of said support member.

17. A wall stand-off apparatus for supporting a ladder adjacent to a substantially vertical surface, said ladder having a pair of side rails for supporting a plurality of ladder rungs therebetween, the apparatus comprising:

two adjustable clamps capable of selective clamping either to one of said ladder rungs or said side rails, each said clamp comprising:

two opposing jaws which are adapted to be attached to a portion of said ladder; and means for securing said portion of the ladder between said jaws; and a support member connected to said clamps such that when said clamps are attached to said ladder the support member extends from the ladder.

18. A wall stand-off apparatus as defined in claim 17 wherein each said clamp further comprises a clamp body and a clamp base and wherein the jaws of said clamps are connected to the clamp body, said clamp body being pivotally mounted on the clamp base, and said support member being connected to the clamp base of each clamp.

19. A wall stand-off apparatus as defined in claim 17 wherein said securing means of the clamps comprises a thumb screw.

20. A wall stand-off apparatus as defined in claim 17 wherein said support member has two extensible legs which are adjustable in a direction toward said vertical surface.

21. A wall stand-off apparatus as defined in claim 17 wherein said support member is substantially U-shaped so as to form two legs which extend towards said vertical surface.

22. A wall stand-off apparatus for supporting an inclined ladder adjacent a substantially vertical wall, the apparatus comprising:

two clamps, each such clamp comprising:

a rigid clamp body;

two, opposing jaws which are pivotally connected to the clamp body, said jaws being adapted to simultaneously hook around a portion of the ladder which is inserted therebetween;

a securing means for securing said portion of the ladder between the jaws; and a clamp base rotatably connected to the clamp body; and a support member having two legs, said support member being connected to the clamp base of each clamp such that, when the clamps are connected to a ladder which is inclined toward said wall, said legs extend from the ladder to the wall, thereby supporting the ladder adjacent the wall.

23. A wall stand-off apparatus as defined in claim 22 wherein the securing means comprises a thumb screw threadably extending through said clamp body in a direction toward said jaws.

24. A wall stand-off apparatus as defined in claim 22 wherein said portion of the ladder is a side rail of the ladder.

25. A wall stand-off apparatus as defined in claim 22 wherein said portion of the ladder is a rung of the ladder.

26. A wall stand-off apparatus as defined in claim 22 wherein said clamps further comprise a clamp base which is formed as an inverted U-channel.

27. A wall stand-off apparatus as defined in claim 26 wherein the clamp body has a hole therein and the clamp base has an upstanding tube thereon and wherein the hole in the clamp body is placed over the upstanding tube on the clamp base, with the upstanding tube being thereafter flared such that the clamp body is rotatably mounted on the clamp base.

28. A wall stand-off apparatus as defined in claim 22 wherein said support member is an elongated tube-like structure having a U-shaped configuration, the ends of the support member forming the two legs.

29. A wall stand-off apparatus as defined in claim 28 wherein the support member comprises two sections, each section having one leg.

* * * * *